US007467981B2

(12) United States Patent
Okuyama et al.

(10) Patent No.: US 7,467,981 B2
(45) Date of Patent: Dec. 23, 2008

(54) REMOTE CONTROL DEVICE AND WATERCRAFT

(75) Inventors: Takashi Okuyama, Hamamatsu (JP); Noriyoshi Ichikawa, Hamamatsu (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/688,818

(22) Filed: Mar. 20, 2007

(65) Prior Publication Data

US 2007/0293102 A1 Dec. 20, 2007

(30) Foreign Application Priority Data

Mar. 20, 2006 (JP) ..... 2006-076871

(51) Int. Cl.
*B60W 10/06* (2006.01)

(52) U.S. Cl. ..... 440/1; 440/84; 440/86; 440/87; 701/21

(58) Field of Classification Search ..... 114/144 RE, 114/146; 440/1, 84, 86, 87; 701/21
See application file for complete search history.

(56) References Cited

U.S. PATENT DOCUMENTS

| | | | |
|---|---|---|---|
| 1,843,272 | A | 2/1932 | Evinrude |
| 2,204,265 | A | 6/1940 | Wentzel |
| 2,466,282 | A | 4/1949 | Sparrow et al. |
| 2,740,260 | A | 4/1956 | Blanchard |
| 3,986,363 | A | 10/1976 | Beaman et al. |
| 4,412,422 | A | 11/1983 | Rossi |
| 4,622,938 | A | 11/1986 | Wenstadt et al. |
| 4,646,696 | A | 3/1987 | Dogadko |
| 4,648,497 | A | 3/1987 | Kawazoe |
| 4,747,381 | A | 5/1988 | Baltz et al. |
| 4,755,156 | A | 7/1988 | Wagner |
| 4,788,955 | A | 12/1988 | Wood |

(Continued)

FOREIGN PATENT DOCUMENTS

| | | |
|---|---|---|
| JP | 03-061196 | 3/1991 |

(Continued)

OTHER PUBLICATIONS

Product catalog of i6000TEC—Triple Engine Electronic Shift & throttle of Teleflex Morse Co., Ltd. (USA).

(Continued)

*Primary Examiner*—Sherman Basinger
(74) *Attorney, Agent, or Firm*—Knobbe, Martens, Olson & Bear, LLP

(57) ABSTRACT

A remote control device can be provided in a watercraft equipped with at least three outboard motors for operating the outboard motors by remote control. The remote control device can have a pair of shift levers and can be provided with a detection device for detecting positions of the shift levers. A remote control-side ECU can control the outboard motors 11 by signals from the detection device. The remote control-side ECU can include a plurality of ECUs corresponding to the outboard motors. The detection device can include a plurality of detection devices for the outboard motors disposed on the sides of the stern of a hull and one for the outboard motor disposed between the side outboard motors. Each of the detection devices can be connected to a respective one of the remote control-side ECUs.

21 Claims, 7 Drawing Sheets

U.S. PATENT DOCUMENTS

| | | | | |
|---|---|---|---|---|
| 4,801,282 | A | 1/1989 | Ogawa | |
| 4,805,396 | A | 2/1989 | Veerhusen et al. | |
| 4,809,506 | A | 3/1989 | Lauritsen | |
| 4,810,216 | A | 3/1989 | Kawamura | |
| 4,836,809 | A | 6/1989 | Pelligrino | |
| 4,850,906 | A | 7/1989 | Kanno et al. | |
| 4,858,585 | A | 8/1989 | Remmers | |
| 4,898,045 | A | 2/1990 | Baba | |
| 4,964,276 | A | 10/1990 | Sturdy | |
| 5,004,962 | A | 4/1991 | Fonss et al. | |
| 5,051,102 | A | 9/1991 | Onoue | |
| 5,062,403 | A | 11/1991 | Breckenfeld et al. | |
| 5,062,516 | A | 11/1991 | Prince | |
| 5,065,723 | A | 11/1991 | Broughton et al. | |
| 5,103,946 | A | 4/1992 | Masters et al. | |
| 5,157,956 | A | 10/1992 | Isaji et al. | |
| 5,167,212 | A | 12/1992 | Peter et al. | |
| 5,273,016 | A | 12/1993 | Gillespie et al. | |
| 5,318,466 | A | 6/1994 | Nagafusa | |
| 5,381,769 | A | 1/1995 | Nishigaki et al. | |
| 5,492,493 | A | 2/1996 | Ohkita | |
| 5,539,294 | A | 7/1996 | Kobayashi | |
| 5,595,159 | A | 1/1997 | Huber et al. | |
| 5,664,542 | A | 9/1997 | Kanazawa et al. | |
| 5,730,105 | A | 3/1998 | McGinnity | |
| 5,749,343 | A | 5/1998 | Nichols et al. | |
| 5,771,860 | A | 6/1998 | Bernardi | |
| 5,782,659 | A | 7/1998 | Motose | |
| 5,899,191 | A | 5/1999 | Rabbit et al. | |
| 6,015,319 | A | 1/2000 | Tanaka | |
| 6,026,783 | A | 2/2000 | Nestvall et al. | |
| 6,058,349 | A | 5/2000 | Kikori et al. | |
| 6,073,509 | A | 6/2000 | Salecker et al. | |
| 6,073,592 | A | 6/2000 | Brown et al. | |
| 6,095,488 | A | 8/2000 | Semeyn, Jr. et al. | |
| 6,098,591 | A | 8/2000 | Iwata | |
| 6,109,986 | A | 8/2000 | Gaynor et al. | |
| 6,233,943 | B1 | 5/2001 | Beacom et al. | |
| 6,273,771 | B1 | 8/2001 | Buckley et al. | |
| 6,280,269 | B1 | 8/2001 | Gaynor | |
| 6,351,704 | B1 | 2/2002 | Koerner | |
| 6,379,114 | B1 | 4/2002 | Schott et al. | |
| 6,382,122 | B1 | 5/2002 | Gaynor et al. | |
| 6,414,607 | B1 | 7/2002 | Gonring et al. | |
| 6,587,765 | B1 | 7/2003 | Graham et al. | |
| 6,612,882 | B2 | 9/2003 | Shidara et al. | |
| 6,704,643 | B1 | 3/2004 | Suhre et al. | |
| 6,751,533 | B2 | 6/2004 | Graham et al. | |
| 6,910,927 | B2 | 6/2005 | Kanno | |
| 6,965,817 | B2 | 11/2005 | Graham et al. | |
| 7,121,908 | B2 * | 10/2006 | Okuyama | 440/84 |
| 7,142,955 | B1 * | 11/2006 | Kern et al. | 701/21 |
| 7,153,174 | B2 | 12/2006 | Takada et al. | |
| 7,220,153 | B2 * | 5/2007 | Okuyama | 440/1 |
| 2003/0082962 | A1 | 5/2003 | Kanno | |
| 2003/0092331 | A1 | 5/2003 | Okuyama | |
| 2003/0093196 | A1 | 5/2003 | Okuyama | |
| 2004/0029461 | A1 | 2/2004 | Shomura | |
| 2005/0118895 | A1 | 6/2005 | Kanno et al. | |
| 2005/0245145 | A1 | 11/2005 | Takada et al. | |
| 2005/0286539 | A1 * | 12/2005 | Okuyama | 370/400 |
| 2006/0240720 | A1 | 10/2006 | Yamashita et al. | |
| 2007/0082565 | A1 * | 4/2007 | Okuyama | 440/1 |
| 2007/0082566 | A1 | 4/2007 | Okuyama | |
| 2007/0178780 | A1 | 8/2007 | Ito et al. | |
| 2007/0218785 | A1 | 9/2007 | Okuyama et al. | |
| 2007/0227429 | A1 | 10/2007 | Okuyama et al. | |
| 2007/0232162 | A1 | 10/2007 | Okuyama et al. | |

FOREIGN PATENT DOCUMENTS

| | | |
|---|---|---|
| JP | 2001-260986 | 9/2001 |
| JP | 2003-098044 | 4/2003 |
| JP | 2003-127986 | 5/2003 |
| JP | 2003-146293 | 5/2003 |
| JP | 2004-068704 | 3/2004 |
| JP | 2004-208452 | 7/2004 |
| JP | 2004-244003 | 9/2004 |
| JP | 2005-272352 | 9/2005 |
| JP | 2005-297785 | 10/2005 |
| JP | 2006-068575 | 3/2006 |
| JP | 2006-074794 | 3/2006 |
| JP | 2006-076871 | 3/2006 |
| JP | 2006-087325 | 4/2006 |
| JP | 2006-115305 | 4/2006 |
| JP | 2006-118039 | 5/2006 |
| JP | 2006-154480 | 6/2006 |
| JP | 2006-156526 | 6/2006 |
| WO | WO2005-102833 | 11/2005 |

OTHER PUBLICATIONS

U.S. Appl. No. 11/731,691, filed Mar. 30, 2007, entitled Remote Control System for a Watercraft.

U.S. Appl. No. 11/731,057, filed Mar. 30, 2007, entitled Remote Control Unit for a Boat.

U.S. Appl. No. 11/731,422, filed Mar. 30, 2007, entitled Remote Control System for a Boat.

U.S. Appl. No. 11/731,086, filed Mar. 30, 2007, entitled Remote Control Device for a Boat.

U.S. Appl. No. 11/731,681, filed Mar. 30, 2007, entitled Remote Control Appratus for a Boat.

Barron, Jim. "Get on the Bus." Trailer Boats Magazine, Jun. 2000, p. 36.

Spisak, Larry. "Know it by Chart." Boating Magazine, May 2000, p. 100.

J.D. "Gains in technology will alter makeup of the . . . " Boating Industry International, Nov. 2000.

Declaration of Daniel J. Carr.

Denn, James. "Future boats sales will hinge on technology." Boating Industry International, Nov. 2000.

Hemmel, Jeff. "Information, Please—The digital boating revolution begins." Boating Magazine, Sep. 2000.

Kelly, Chris. "Can We Talk?" Power & Motoryacht Magazine, Jun. 2000, pp. 36 & 38, 39.

"Plug and Play" Advertisement from "Motorboating", Dec. 2000, p. 57.

"MagicBus™ i3000 Series Intelligent Steering" Instruction Manual. Telefex, Inc.

* cited by examiner

REMOTE CONTROL DEVICE AND WATERCRAFT

PRIORITY INFORMATION

This application is based on and claims priority to Japanese Patent Application No. 2006-076871, filed Mar. 20, 2006, the entire contents of which is hereby expressly incorporated by reference.

BACKGROUND OF THE INVENTIONS

1. Field of the Inventions

The present inventions relate to remote control devices in which remote control of advancing, neutral, reversing, and adjusting the velocity of a watercraft can be performed by operating an operating lever.

2. Description of the Related Art

Japanese Patent Document JP-A-2005-297785 describes a remote control operating device for a watercraft having, the remote control device having an operating lever for operating remote control of advancing, neutral and reversing. A watercraft propulsion device is disclosed as having a gear shift device for the shifting gears between advancing ("forward"), neutral and reversing, and a shift actuator for driving the shift changing device. A control means is provided for controlling the amount of movement of the shift actuator based on the amount of operation of the operating lever, wherein the operating lever can be moved over a specified range from the neutral position. The control means controls the amount of movement of the actuator according to a unit amount of operation of the operating lever. As such, the proportional relationship between the position of the operation lever and the position of the actuator can differ in a portion within the gear shifting range of the operation lever.

SUMMARY OF THE INVENTIONS

An aspect of at least one of the embodiments disclosed herein includes the realization that, in a system such as that described in Japanese Patent Document JP-A-2005-297785, difficulties arise when adapting such a system for use with greater numbers of propulsion units. For example, when such a system is adapted to be used with three outboard motors, the number of remote control-side ECUs corresponding to the number of outboard motors are connected to their respective outboard motors. In such a system, only two levers are provided and position sensors are provided to detect the position for each operating lever. These sensors are connected to both remote control-side ECUs connected to the outboard motors disposed on both left and right sides of the stern. Additionally, both of these left and right side remote control-side ECUs are connected to the center remote control-side ECU connected to the center outboard motor. Thus, when each operating lever is operated, signals are sent through the left and right side remote control-side ECUs to the center remote control-side ECU to control the center outboard motor.

In such a case, the center remote control-side ECU can be affected by the left and right side remote control-side ECUs, resulting in difficulties in securing independence for each outboard motor. Thus, an object of at least one of the embodiments disclosed herein is to provide a remote control device and a watercraft in which independence of each watercraft propulsion device is secured as well as reliability even when the number of propulsion units is greater than the number of operation levers on the remote control units, for example, when there are three outboard motors connected to a two-lever remote control unit.

Thus in accordance with at least one of the embodiments disclosed herein, a remote control device for at least three propulsion devices of a watercraft can comprise a pair of operating levers, a detection device configured to for detect positions of the operating levers, and a remote control-side ECU configured to control the watercraft propulsion devices in accordance with signals from the detection device. The remote control-side ECU can comprise a plurality of respective ECUs corresponding to said watercraft propulsion devices. The detection device can comprise a plurality of respective detection devices, at least one respective detection device corresponding to each of said watercraft propulsion devices disposed on the sides of a stern a hull of the watercraft and at least one respective detection device corresponding to the watercraft propulsion device disposed between said watercraft propulsion devices disposed on the sides of the stern. Each of the detection devices can be connected to a respective ECU.

In accordance with at least one of the embodiments disclosed herein, a remote control device for at least three propulsion devices of a watercraft can comprise first and second operating levers, the remote control device configured to control the power output of all three propulsion devices with the first and second operating levers. The remote control device can also include at least first, second, and third remote control-side ECUs, and at least first, second, and third detection devices configured to detect positions of at least one of the pair of operating levers. The first, second, and third detection devices can be connected to the first, second, and third control-side ECUs.

BRIEF DESCRIPTION OF THE DRAWINGS

The above-mentioned and other features of the inventions disclosed herein are described below with reference to the drawings of the preferred embodiments. The illustrated embodiments are intended to illustrate, but not to limit the inventions. The drawings contain the following Figures.

DETAILED DESCRIPTION OF THE PREFERRED EMBODIMENT

Improved watercraft and remote control systems for watercraft are disclosed herein. Although the present boats and remote control systems are illustrated and described in the context of an outboard motor-powered boat, the present inventions can be used with other types of remote control systems and other types of vehicles.

Figure 1:
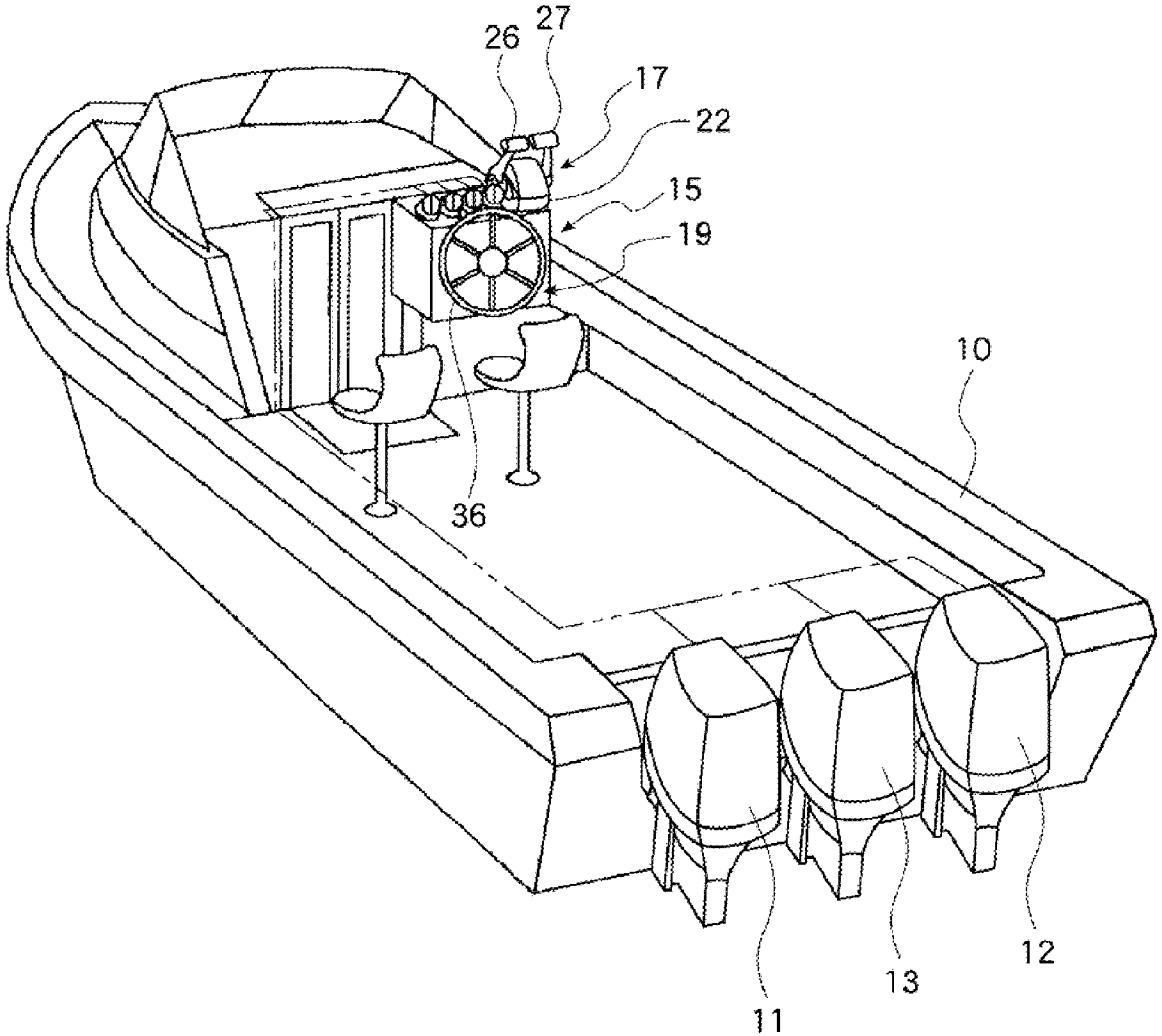
FIG. 1 is a perspective view of a watercraft having a remote control device according to an embodiment.
Figure 2:
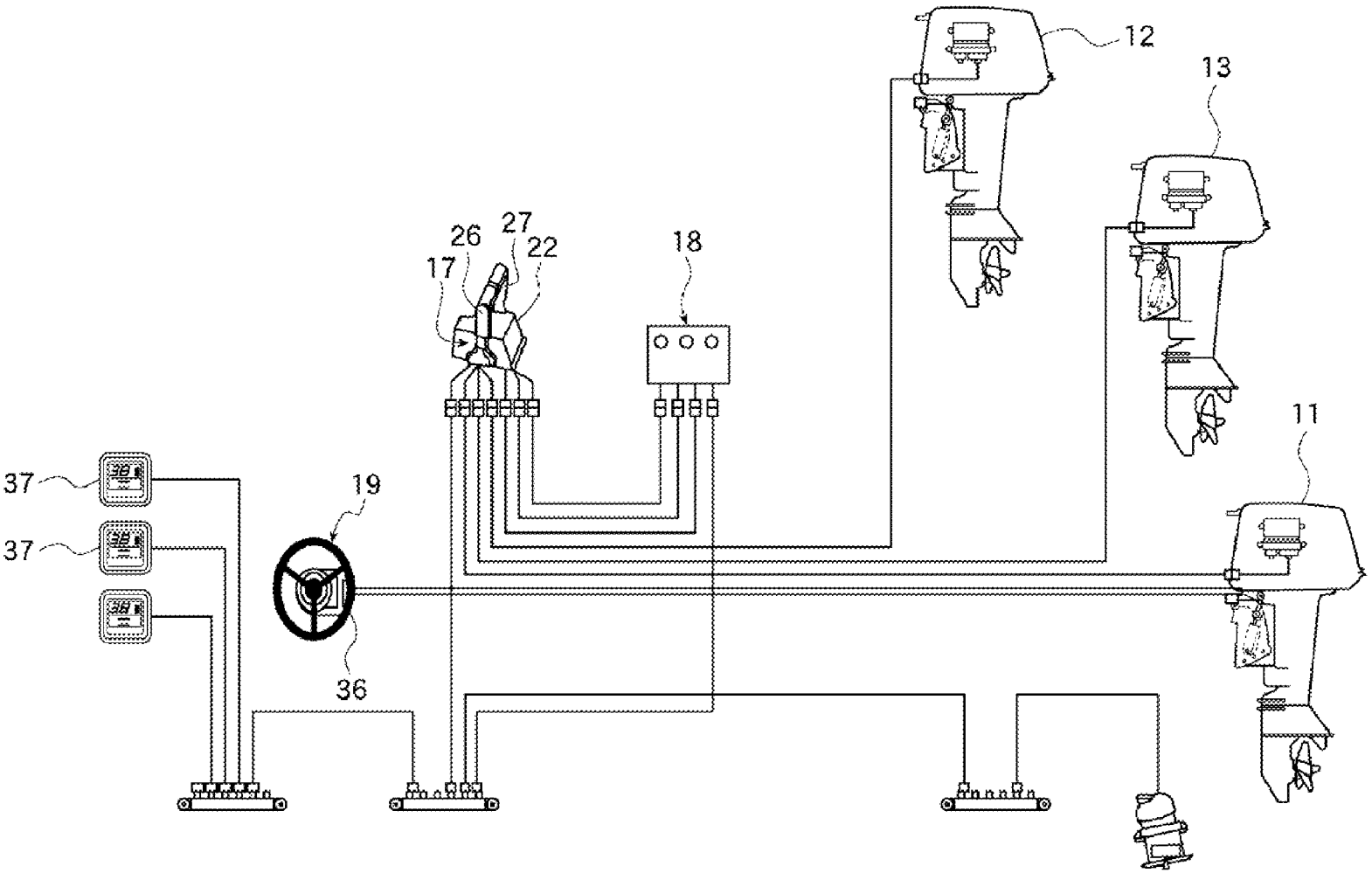
FIG. 2 is a schematic illustration of the connection of the remote control device and outboard motors of the watercraft.
Figure 3:
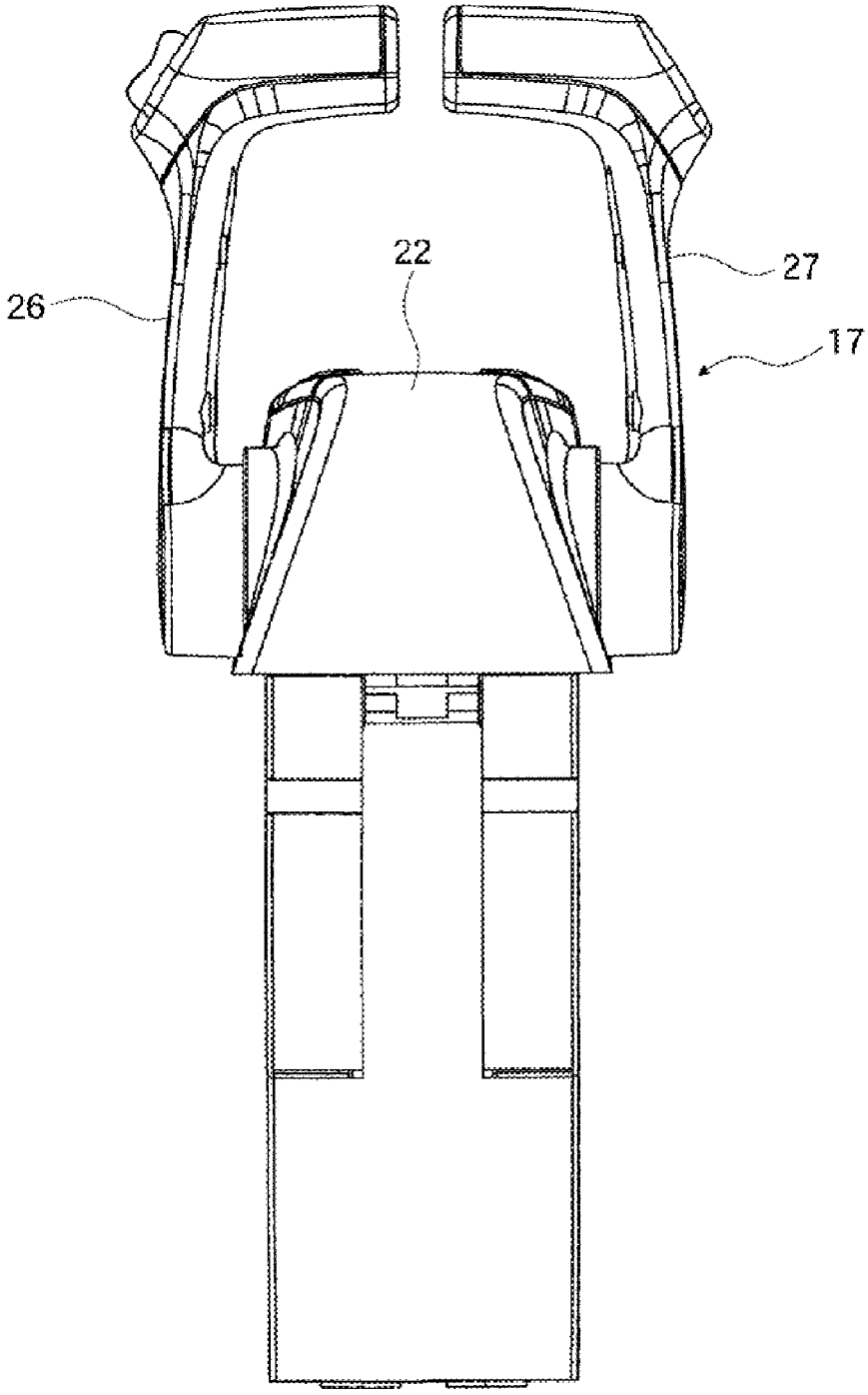
FIG. 3 is a rear elevational view of the remote control device of FIGS. 1 and 2.
Figure 4:
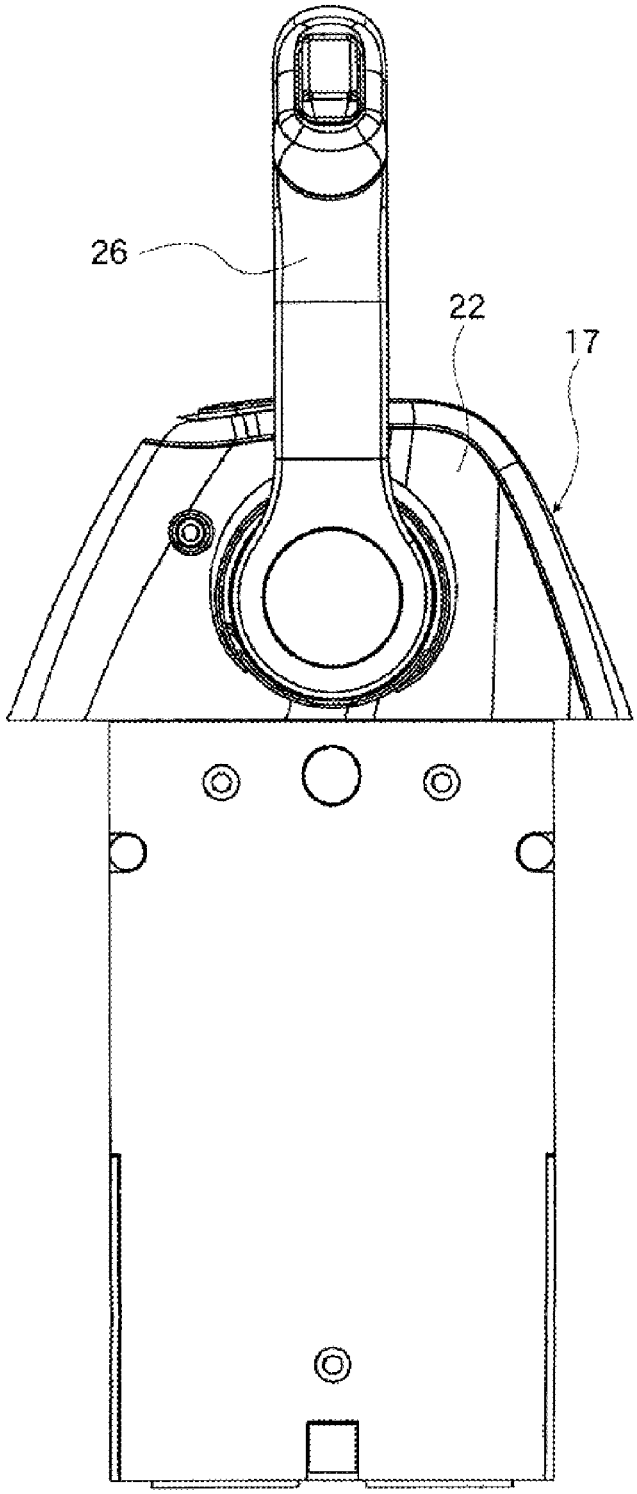
FIG. 4 is a left side elevational view of the remote control device.

Referring first to the construction, a watercraft can be configured, as shown in FIG. 1 and FIG. 2, such that three outboard motors 11, 12, 13 as "watercraft propulsion devices" can be mounted to the stern in a hull 10. A remote control device 17, a key switching device 18 and a steering device 19, etc. can also be disposed in a driver's seat 15 provided on the hull 10. The outboard motors 11, 12, 13 can be controlled with these devices.

Figure 5:
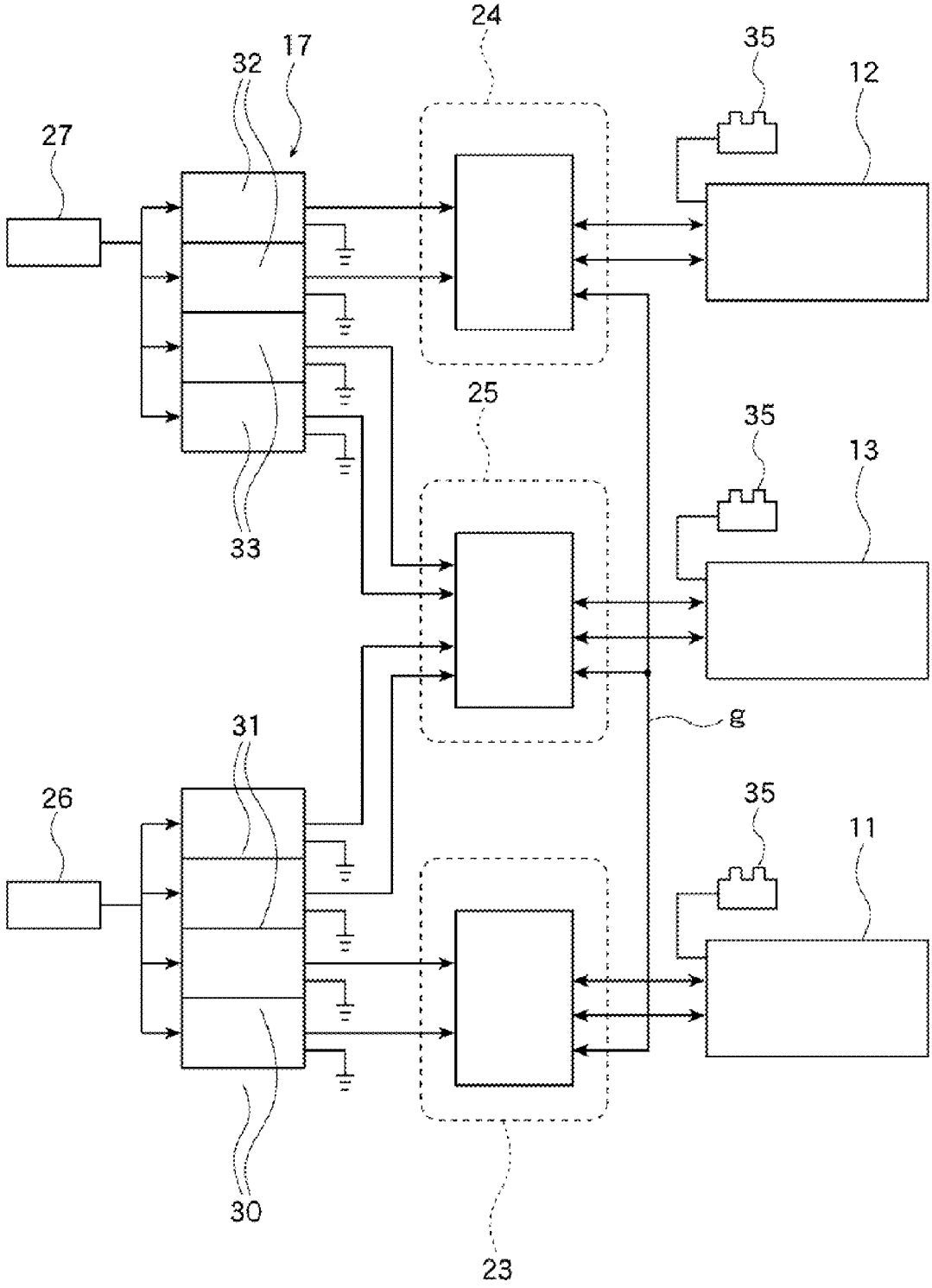
FIG. 5 is a block diagram showing the connection of shift levers, detection devices, remote control-side ECUs and outboard motors.

In the remote control device 17 of the driver's seat 15, as shown in FIG. 1-FIG. 4, shift levers 26, 27 as a pair of "operating levers" can be provided for rotation or pivoting on a remote control body 22 for the throttle and shift operation. As shown in FIG. 5, inside the remote control body 22, a left remote control-side ECU 23 connected to the left outboard motor 11 can be disposed at the left side and a right remote control-side ECU 24 connected to the right outboard motor 12 can be disposed at the right side. Optionally, a center remote control-side ECU 25 can be connected to the center outboard motor 13 disposed at the center. The ECUs 23, 24, 25 can be built into the remote control device 17.

The remote control device 17 can be provided with, for one (left side) shift lever 26, two left detection devices (lever position sensors) 30 connected to the left remote control-side ECU 23, and two first center detection devices 31 connected to the center remote control-side ECU 25. These lever position sensors can be include a Hall IC, for example. As such, when the shift levers 26, 27 are rotated, the magnetic field changes and this change is converted into change in voltage by the Hall IC for the detection of the position of rotation.

Thus, the left remote control-side ECU 23 and the two left detection devices 30 are connected through two signal circuit systems, and the center remote control-side ECU 25 and the two first center detection devices 31 are connected through two signal circuit systems.

Further, two right detection devices 32 can be connected to the right remote control-side ECU 24, and two second center detection devices 33 can be connected to the center remote control-side ECU 25 for detection of the movement of the other (right side) shift lever 27. Thus, the right remote control-side ECU 24 and the two right detection devices 32 are connected through two signal circuit systems, and the center remote control-side ECU 25 and the two second center detection devices 33 are connected through two signal circuit systems. These detection devices 30, 31, 32, 33 can each have an independent ground.

As a result, signals are transmitted to the center remote control-side ECU 25 from both the shift levers 26, 27 through the first and second center detection devices 31, 33. This center remote control-side ECU 25 can be arranged such that when signals of different detection values are input into the center remote control-side ECU 25 from the first center detection device 31 and second center detection device 33, the center remote control-side ECU 25 calculates a mean value of the different detection values to control the center outboard motor 13 based on the mean value.

The plurality of remote control-side ECUs 23, 24, 25 can be connected for communication to each other by an inter-ECU communication cable g.

Further, a key switching device 18 can be connected to these remote control-side ECUs 23, 24, 25. This key switching device 18 can be provided with main switches, starting switches, stopping switches and buzzers (not shown) each corresponding to their respective remote control-side ECUs 23, 24, 25. Additionally, these components can be connected to the remote control-side ECUs 23, 24, 25 through signal circuits.

Further, the steering device 19 in the driver's seat 15 has an unillustrated steering wheel-side ECU built in and is provided with a steering wheel 36 for the steering so that the position of rotation (position of rotation angle) of the steering wheel 36 is detected by a position sensor, and the position sensor is connected to the steering wheel-side ECU through a signal circuit.

The steering wheel-side ECU is connected to the remote control-side ECUs 23, 24, 25 through a DBW CAN cable as a signal line. Here, DBW is an abbreviation of the term "Drive-by-Wire", referring to the control device using electrical connection in place of mechanical connection, and CAN is an abbreviation of the term "Controller Area Network".

The left remote control-side ECU 23 can be connected to an unillustrated engine-side ECU provided on the left outboard motor 11 through a power cable and a DBW CAN cable. Similarly, the right remote control-side ECU 24 can be connected to an unillustrated engine-side ECU provided on the right outboard motor 12 through a power cable and a DBW CAN cable. Additionally, the center remote control-side ECU 25 can be connected to an unillustrated engine-side ECU provided on the center outboard motor 13 through a power cable and a DBW CAN cable.

Three batteries 35, as power sources, can be connected to these outboard motors 11, 12, 13, respectively.

As a result, connections between the plurality of remote control-side ECUs 23, 24, 25 and the detection devices 30, 31, 32, 33 each have a circuit structure in which an independent battery 35 and independent ground are provided.

These engine-side ECUs can each be arranged such that engine operation conditions such as fuel injection quantity, injection timing and ignition timing can be controlled as appropriate based on throttle opening from a throttle opening sensor, engine speed from a crank angle sensor and detection values from other sensors.

Further, various detection values (operating information) such as throttle opening and engine speed can be transmitted from the engine-side ECUs to the remote control-side ECUs 23, 24, 25 corresponding to the engine-side ECUs through DBW CAN cables, and between the remote control-side ECUs 23, 24, 25, this operating information being transmitted through the inter-ECU communication circuit g.

Thus, the engine-side ECUs of the outboard motors 11, 12, 13 can be controlled by control signals from the remote control-side ECUs 23, 24, 25, so that fuel injection quantity, injection timing and ignition timing, etc. are controlled such that the difference in engine speed between the outboard motors 11, 12, 13 falls within the range of target values.

Numeral 37 in FIG. 2 designates a gage.

In some embodiments where a pair of shift levers 26, 27 are provided with the first and second detection devices 31, 32 being dedicated to the center outboard motor 13 (center remote control-side ECU 25), it is possible for the center remote control-side ECU 25 to perform independent control without signal input from the other remote control-side ECUs 23, 24, securing independence for each of the outboard motors 11, 12, 13 (engines). Additionally, since signals are transmitted from the first and second center detection devices 31, 32 directly to the center remote control-side ECU 25, the response characteristics of the outboard motor 13 to the shift levers 26, 27 can be improved.

In addition, signals can be transmitted to the center remote control-side ECU 25 from both the shift levers 26, 27 through the first and second center detection devices 31, 33. This center remote control-side ECU 25 can be arranged such that when signals of different detection values are input into the center remote control-side ECU 25 from the first center detection device 31 and second center detection device 33, the center remote control-side ECU 25 can calculate a mean value of the different detection values to control the center outboard motor 13 based on the mean value, so that middle position control of the pair of left and right shift levers 26, 27 can be performed, enabling control of the three outboard motors 11, 12, 13 even by the pair of shift levers 26, 27.

Further, transmitting operating information mutually between the remote control-side ECUs 23, 24, 25, their through the inter-ECU communication circuit g, enables backup of the input from each of the detection devices 30, 31, 32, 33, improving reliability.

Additionally, connections between the plurality of remote control-side ECUs 23, 24, 25 and the detection devices 30, 31, 32, 33 corresponding to the remote control-side ECUs 23, 24, 25 each have a circuit structure in which an independent battery 35 and independent ground can be provided, securing independence of the power source for each of the outboard motors 11, 12, 13 more reliably.

Figure 6:
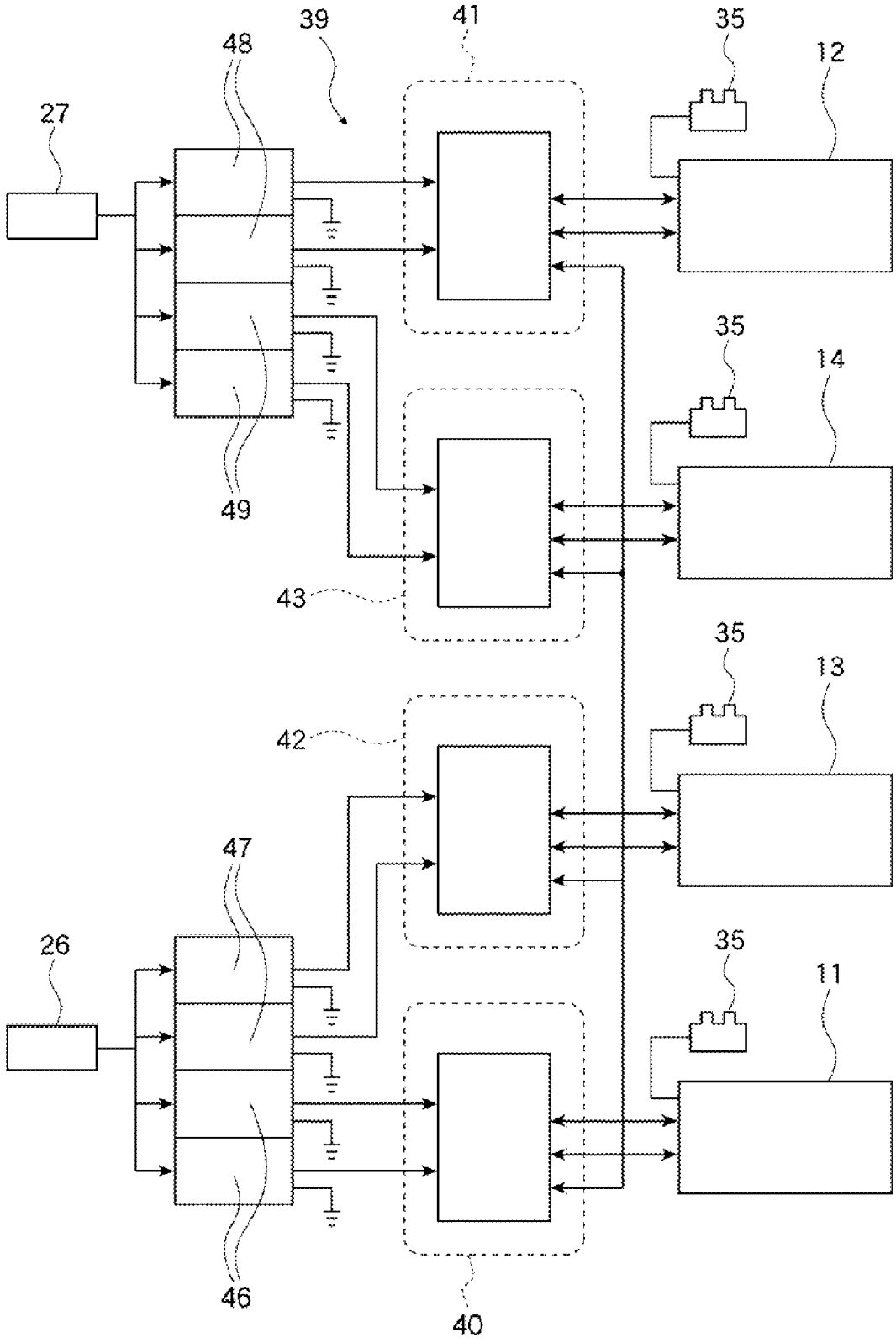
FIG. 6 is a block diagram illustrating a modification of the connection of shift levers, detection devices, remote control-side ECUs and outboard motors of FIG. 5.

FIG. 6 illustrates a modification including four outboard motors 11, 12, 13, 14. That is, the remote control device 39 can be provided with four remote control-side ECUs 40, 41, 42, 43, each connected to a respective one of the four outboard motors 11, 12, 13, 14. These remote control-side ECUs 40, 41, 42, 43 can be connected to the outboard motors 11, 12, 13, 14 by two circuit systems, respectively.

In addition, for one shift lever 26, two detection devices (left detection device 46 and first center detection device 47) connected to two remote control-side ECUs (left remote control-side ECU 40 and first center remote control-side ECU 42) can be provided.

Further, for the other shift lever 27, other two detection devices (right detection device 48 and second center detection device 49) connected to other two remote control-side ECUs (right remote control-side ECU 41 and second center remote control-side ECU 43) can be provided.

These remote control-side ECUs 40, 41, 42, 43 can be connected to the detection devices 46, 47, 48, 49 by two circuit systems, respectively. Thus, in the case where four outboard motors are provided, independent control is also possible, securing independence for each of the outboard motors 11, 12, 13 (engines).

Figure 7:
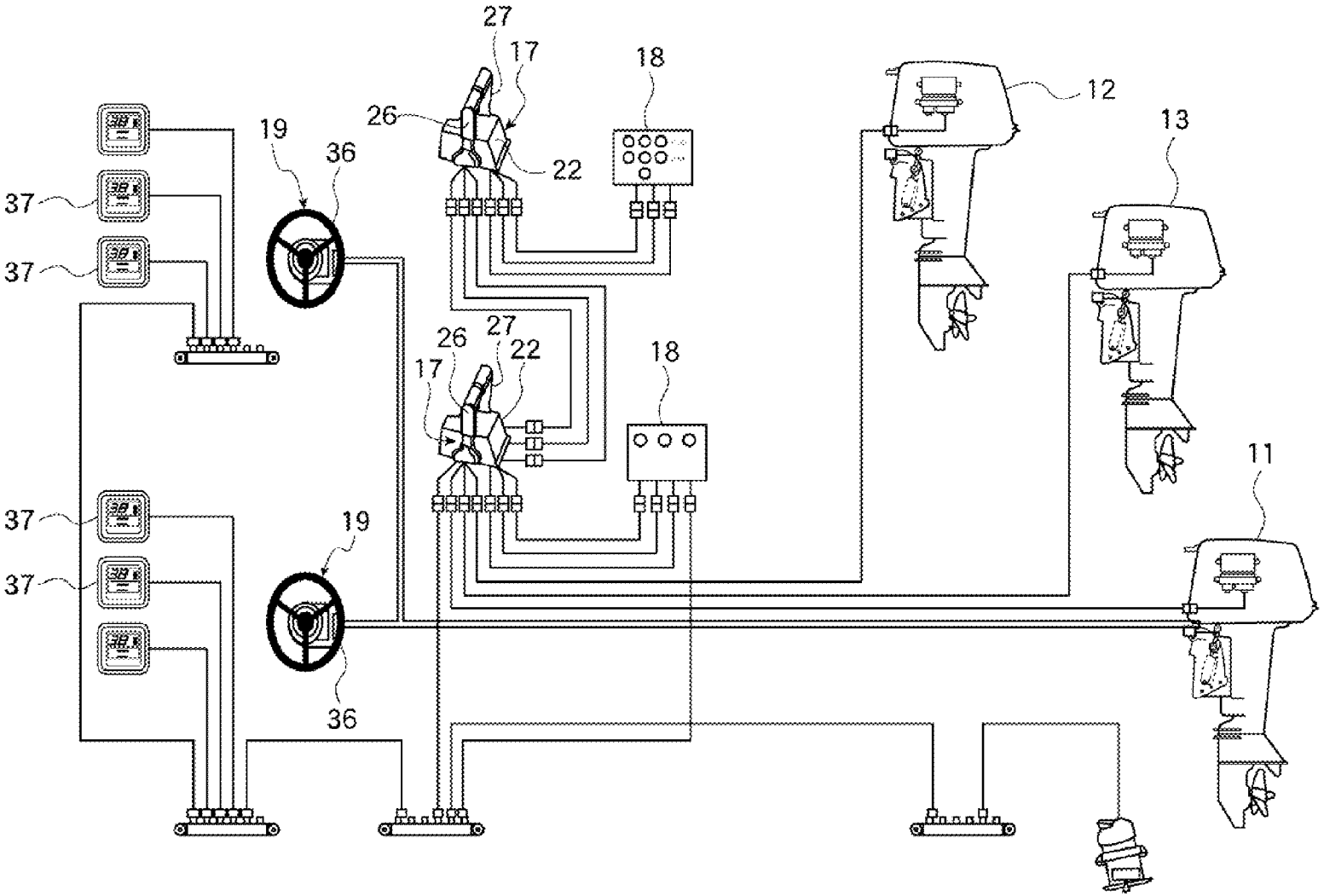
FIG. 7 is a schematic illustration of a modification of the connection of remote control devices and outboard motors illustrated in FIG. 2.

FIG. 7 illustrates yet another modification including a system of three outboard motors and two remote control stations. In this modification, there can be three outboard motors 11, 12, 13, and on each side of the main station and sub-station, a remote control device 17, key switching device 18 and steering device 19 approximately the same as the system illustrated in FIGS. 1-5.

In the modification illustrated in FIG. 7, the same effects and functions as those provided by the system of FIGS. 1-5 can also be achieved.

Although in the foregoing embodiments, the outboard motors 11 . . . are used for the "watercraft propulsion devices," the inventions disclosed herein are not limited to such, and it is to be understood that inboard engines can also be used satisfactorily.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A remote control device for at least three propulsion devices of a watercraft, comprising a pair of operating levers, a detection device configured to detect positions of the operating levers, a remote control-side ECU configured to control the watercraft propulsion devices in accordance with signals from the detection device, the remote control-side ECU comprising a plurality of respective ECUs corresponding to said watercraft propulsion devices, said detection device comprising a plurality of respective detection devices, at least one respective detection device corresponding to each of said watercraft propulsion devices disposed toward sides of a stern of a hull of the watercraft and at least one respective detection device corresponding to each one of said watercraft propulsion device disposed between said watercraft propulsion devices disposed toward the sides of the stern, wherein each of the detection devices is connected to a respective ECU.

2. The remote control device as set forth in claim 1, wherein respective ECUs comprise at least a left remote control-side ECU connected to the watercraft propulsion device disposed at a left side of the stern of the hull, at least a right remote control-side ECU connected to the watercraft propulsion device disposed at a right side of the stern of the hull, and at least a center remote control-side ECU connected to the watercraft propulsion device disposed between the left and right sides of the stern of the hull;

wherein said at least one respective detection device corresponding to each of said watercraft propulsion devices disposed toward sides of a stern comprises a left side detection device and a right side detection device;

wherein said at least one respective detection device corresponding to the watercraft propulsion device disposed between said watercraft propulsion devices comprises at least first and second center detection devices, and wherein said pair of levers comprises at least first and second levers;

wherein said left detection device and said first center detection device are configured to detect a position of the first lever, said left detection device being connected to said left remote control-side ECU, and said first center detection device being connected to said center remote control-side ECU; and wherein said right side detection device and said second center detection device are configured to detect a position of said second lever, said right detection device being connected to said right remote control-side ECU, and said second center detection device connected to said center remote control-side ECU.

3. The remote control device as set forth in claim 2, wherein the center remote control-side ECU is configured to calculate a mean value of different detection values input into the center remote control-side ECU from said first center detection device and said second center detection device and to control said center watercraft propulsion device based on the mean value.

4. The remote control device as set forth in claim 3, wherein said plurality of respective ECUs are connected for communication to each other.

5. The remote control device as set forth in claim 3, wherein connections between said plurality of respective ECUs and said detection devices corresponding to the respective ECUs, each have a circuit structure in which an independent power source and independent ground are provided.

6. The remote control device as set forth in claim 3 in combination with a watercraft.

7. The remote control device as set forth in claim 2 wherein said plurality of respective ECUs are connected for communication to each other.

8. The remote control device as set forth in claim 2, wherein connections between said plurality of respective ECUs and said detection devices corresponding to the respective ECUs, each have a circuit structure in which an independent power source and independent ground are provided.

9. The remote control device as set forth in claim 2 in combination with a watercraft.

10. The remote control device as set forth in claim 1, wherein the watercraft includes first, second, third and fourth watercraft propulsion devices, wherein the remote control device comprises first, second, third, and fourth respective ECUs, each being connected to a respective one of said first, second, third and fourth watercraft propulsion devices, wherein said at least one respective detection device corresponding to each of said watercraft propulsion devices disposed toward sides of a stern comprises a first detection device and a fourth detection device, wherein said at least one respective detection device corresponding to the watercraft propulsion device disposed between said watercraft propulsion devices comprises at least second and third detection devices, and wherein the first and second detection devices are connected to first and second remote control-side ECUs and are configured to detect a position of a first of said pair of operating levers, and wherein third and fourth detection devices are connected to said third and fourth remote control-side ECUs and are configured to detect a position of a second lever of said pair of operation levers.

11. The remote control device as set forth in claim 10, wherein said plurality of respective ECUs are connected for communication to each other.

12. The remote control device as set forth in claim 10, wherein connections between said plurality of respective ECUs and said detection devices corresponding to the respective ECUs, each have a circuit structure in which an independent power source and independent ground are provided.

13. The remote control device as set forth in claim 10 in combination with a watercraft.

14. The remote control device as set forth in claim 10, wherein the first and fourth propulsion devices are disposed towards the lateral sides of the hull and the second and third propulsion devices are disposed between the first and fourth propulsion devices.

15. The remote control device as set forth in claim 1, wherein said plurality of respective ECUs are connected for communication to each other.

16. The remote control device as set forth in claim 15 in combination with a watercraft.

17. The remote control device as set forth in claim 1, wherein connections between said plurality of respective ECUs and said detection devices corresponding to the respective ECUs, each have a circuit structure in which an independent power source and independent ground are provided.

18. The remote control device as set forth in claim 1 in combination with a watercraft.

19. A remote control device for at least three propulsion devices of a watercraft, comprising first and second operating levers, the remote control device configured to control the power output of all three propulsion devices with the first and second operating levers, at least first, second, and third remote control-side ECUs, at least first, second, and third detection devices, the first detection device being configured to detect positions of at least one of the pair of operating levers, the second detection device being configured to detect positions of at least one of the pair of operating levers, and the third detection device being configured to detect positions of at least one of the pair of operating levers, the first, second, and third detection devices being connected to the first, second, and third control-side ECUs.

20. The remote control device as set forth in claim 19, wherein the first detection device is configured to detect a position of the first lever, the second detection device being configured to detect a position of the second lever, and the third detection device being configured to detect positions of both the first and second levers.

21. The remote control device as set forth in claim 20, wherein the third detection device comprises first and second position sensors, the first position sensor being configured to detect a position of the first lever, the second position sensor being configured to detect a position of the second lever.

* * * * *